US007748343B2

(12) United States Patent
Kim et al.

(10) Patent No.: US 7,748,343 B2
(45) Date of Patent: Jul. 6, 2010

(54) ELECTROHYDRODYNAMIC SPRAYING SYSTEM

(75) Inventors: Kyekyoon Kim, Champaign, IL (US); Ravindra Pratap Singh, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 758 days.

(21) Appl. No.: 10/995,049

(22) Filed: Nov. 22, 2004

(65) Prior Publication Data

US 2006/0110544 A1 May 25, 2006

(51) Int. Cl.
*B05B 5/025* (2006.01)

(52) U.S. Cl. ..... 118/621; 118/625; 118/628; 118/629; 239/706; 361/228

(58) Field of Classification Search ..... 118/621, 118/625, 627, 629, 638, 504, 505; 427/457, 427/458, 475, 483, 485, 486, 468, 421; 239/698, 239/692, 701–704, 706, 707, 690, 697, 548, 239/550, 556, 557, 566; 96/27, 53, 71; 128/200.14; 250/281, 285, 288; 385/12, 117, 118; 435/285.2, 435/285.3; 361/228, 235
See application file for complete search history.

(56) References Cited

U.S. PATENT DOCUMENTS

| | | | | |
|---|---|---|---|---|
| 3,579,245 | A | | 5/1971 | Berry |
| 4,356,528 | A | | 10/1982 | Coffee |
| 4,444,961 | A | | 4/1984 | Timm |
| 4,748,043 | A | | 5/1988 | Seaver et al. |
| 4,795,330 | A | * | 1/1989 | Noakes et al. ..... 425/6 |
| 4,861,627 | A | | 8/1989 | Mathiowitz et al. |
| 5,019,400 | A | | 5/1991 | Gombotz et al. |
| 5,260,002 | A | | 11/1993 | Wang |
| 5,340,090 | A | | 8/1994 | Orme et al. |
| 5,344,676 | A | | 9/1994 | Kim et al. |
| 5,445,666 | A | | 8/1995 | Peschka et al. |
| 5,462,866 | A | | 10/1995 | Wang |

(Continued)

FOREIGN PATENT DOCUMENTS

CA 2419115 2/2002

(Continued)

OTHER PUBLICATIONS

Reyderman, L. et al., "Novel methods of microparticulate production: application to drug delivery," Pharm. Dev. Technol, vol. 1, No. 3, pp. 223-229, (1996).

(Continued)

*Primary Examiner*—Yewebdar T Tadesse
(74) *Attorney, Agent, or Firm*—Ed Guntin; Guntin Meles & Gust, PLC

(57) ABSTRACT

An electrohydrodynamic spray apparatus includes a liquid inlet and a spray nozzle in fluid communication with the liquid inlet, where the spray nozzle has an opening downstream of the liquid inlet. An inner electrode is situated at least partially inside the spray nozzle. An outer electrode is situated external to the spray nozzle and within about 100 mm of the opening of the nozzle. The electrohydrodynamic spray apparatus can be combined with a substrate to form an electrohydrodynamic spray system. The electrohydrodynamic spray apparatus or system can be used to form nanostructures such as nanodrops, nanoparticles and thin films.

19 Claims, 11 Drawing Sheets

U.S. PATENT DOCUMENTS

| | | | | |
|---|---|---|---|---|
| 5,650,173 | A | 7/1997 | Ramstack et al. | |
| 5,654,008 | A | 8/1997 | Herbert et al. | |
| 5,667,808 | A | 9/1997 | Johnson et al. | |
| 5,674,534 | A | 10/1997 | Zale et al. | |
| 5,711,968 | A | 1/1998 | Tracy et al. | |
| 5,716,644 | A | 2/1998 | Zale et al. | |
| 5,720,436 | A * | 2/1998 | Buschor | 239/706 |
| 5,792,477 | A | 8/1998 | Rickey et al. | |
| 5,817,343 | A | 10/1998 | Burke | |
| 5,874,111 | A | 2/1999 | Maitra et al. | |
| 5,891,478 | A | 4/1999 | Johnson et al. | |
| 5,912,015 | A | 6/1999 | Bernstein et al. | |
| 5,916,597 | A | 6/1999 | Lee et al. | |
| 5,916,598 | A | 6/1999 | Rickey et al. | |
| 5,922,253 | A | 7/1999 | Herbert et al. | |
| 5,948,483 | A | 9/1999 | Kim et al. | |
| 5,954,907 | A | 9/1999 | LaRose et al. | |
| 5,985,354 | A | 11/1999 | Mathiowitz et al. | |
| 5,989,463 | A | 11/1999 | Tracy et al. | |
| 6,051,259 | A | 4/2000 | Johnson et al. | |
| 6,060,128 | A | 5/2000 | Kim et al. | |
| 6,110,503 | A | 8/2000 | Rickey et al. | |
| 6,110,921 | A | 8/2000 | Mesens et al. | |
| 6,116,516 | A | 9/2000 | Ganan-Calvo | |
| 6,119,953 | A | 9/2000 | Ganan-Calvo et al. | |
| 6,153,129 | A | 11/2000 | Herbert et al. | |
| 6,174,469 | B1 | 1/2001 | Ganan-Calvo | |
| 6,183,781 | B1 | 2/2001 | Burke | |
| 6,187,214 | B1 | 2/2001 | Ganan-Calvo | |
| 6,194,006 | B1 | 2/2001 | Lyons et al. | |
| 8,189,803 | | 2/2001 | Ganan-Calvo | |
| 6,196,525 | B1 | 3/2001 | Ganan-Calvo | |
| 6,197,835 | B1 | 3/2001 | Ganan-Calvo | |
| 6,224,794 | B1 | 5/2001 | Amsden et al. | |
| 6,302,331 | B1 | 10/2001 | Dvorsky et al. | |
| 6,447,752 | B2 | 9/2002 | Edwards et al. | |
| 6,447,753 | B2 | 9/2002 | Edwards et al. | |
| 6,458,296 | B1 | 10/2002 | Heinzen et al. | |
| 6,458,387 | B1 | 10/2002 | Scott et al. | |
| 6,669,961 | B2 | 12/2003 | Kim et al. | |
| 7,241,344 | B2 * | 7/2007 | Worsham et al. | 118/629 |
| 7,309,500 | B2 | 12/2007 | Kim et al. | |
| 7,368,130 | B2 | 5/2008 | Kim et al. | |
| 2002/0054912 | A1 | 5/2002 | Kim et al. | |
| 2002/0160109 | A1 | 10/2002 | Yeo et al. | |
| 2004/0022939 | A1 | 2/2004 | Kim et al. | |
| 2004/0079360 | A1 | 4/2004 | Coffee et al. | |
| 2005/0123614 | A1 | 6/2005 | Kim et al. | |
| 2008/0175915 | A1 | 7/2008 | Kim et al. | |
| 2008/0181964 | A1 | 7/2008 | Kim et al. | |

FOREIGN PATENT DOCUMENTS

| | | | |
|---|---|---|---|
| CH | 675 370 | A5 | 9/1990 |
| DE | 27 25 849 | A1 | 12/1978 |
| EP | 0 258 016 | A | 3/1988 |
| EP | 0 265 924 | A2 | 4/1988 |
| WO | WO 97/31691 | | 4/1997 |
| WO | WO 98/58745 | | 12/1998 |
| WO | WO 99/44735 | | 10/1999 |
| WO | WO 02/13786 | | 2/2002 |
| WO | WO 2006/057766 | A1 | 6/2006 |
| WO | WO 2005/055988 | | 8/2006 |

OTHER PUBLICATIONS

Aldrich, "Microparticle Size Standards," Aldrich Technical Bulletin, AL-203, pp. 1-2, 1997.

Amsden, B., "The production of uniformly sized polymer microspheres," Pharm. Res. 16, 1140-1143, 1999.

Amsden, B.G. et al., "An examination of factors affecting the size, distribution, and release characteristics of polymer microbeads made using electrostatics," J. Controlled Rel. 43, 183-196, 1997.

Banerjee, T., et al., "Preparation, characterization and biodistribution of ultrafine chitosan nanoparticles," Int. J. Pharm. 243, 93-105, 2002.

Berkland, C. et al., "Fabrication of PLG microspheres with precisely controlled and monodisperse size distributions," Journal of Controlled Release, vol. 73, pp. 59-74, May 18, 2001.

Berkland, C., et al., "Precise control of PLG microsphere size provides enhanced control of drug release rate," Journal of Controlled Release, vol. 82. pp. 137-147, 2002.

Berkland, et al., "Controlled Release from Uniform Two-Polymer Microcapsules", Proceedings of the International Symposium on Controlled Release of Bioactive Materials, vol. 30, p. 350, (2003).

Bittner, B. et al., "Ultrasonic Atomization for Spray Drying: A Versatile Technique for the Preparation of Protein Loaded Biodegradable Microspheres," Journal of Microencapsulation, vol. 16:3, p. 325-341, 1999.

Brandau, T., "Preparation of monodisperse controlled release microcapsules," Int. J. Pharm. 242: 179-184, 2002.

Crotts, G. et al., "Preparation of porous and nonporous beiodegradable polymeric hollow microspheres," J. Controlled Rel. 35, 91-105, 1995.

Foster, C.A., et al., "Apparatus for producing uniform solid spheres of hydrogen," Rev. Sci. Instrum., vol. 48, No. 6, pp. 625-631, 1977.

Gilliard, R.P., et al., "Spherical hydrogen pellet generator for magnetic confinement fusion research," Rev. Sci. Instrum., vol. 52, No. 2, pp. 183-190, 1981.

Guttman, C.D. et al., "An investigation of the effects of system parameters on the production of hollow hydrogen droplets," J. Appl. Phys., vol. 50, No. 6, pp. 4139-4142, Jun. 1979.

He, P., et al., "Chitosan microspheres prepared by spray drying," Int. J. Pharm. 187, 53-65, 1999.

Hendricks, C.D., et at., "Interaction of a stream of dielectric spheres in an electric field in a high vacuum," IEEE Trans. Ind. Appl., vol. Ia-21, No. 3, pp. 705-708, 1985.

Huang, Y., et al., "Formulation factors in preparing BTM-chitosan microspheres by spray drying method," Int. J. Pharm. 242, 239-242, 2002.

International Search Report dated Mar. 16, 2008 for PCT application No. PCT/US2004/040195.

Jang, K.Y. et al., "Evaluation of sol-gel processing as a method for fabricating spherical-shell silica aerogel ICF targets," J. Vac. Technol. A, vol. 10, No. 4, pp. 1152-1157, 1992.

Jang, K.Y. et al., "Study of sol-gel processing for fabrication of hollow silica-aerogel spheres," J. Vac. Sci. Technol. A, 8:3, pp. 1732-1735, 1990.

Kim, K. et al., "Generation of charged drops of insulating liquids by electrostatic spraying," J. Appl. Phys., vol. 47, No. 5, pp. 1964-1969, May 1976.

Kim, K. et al., "Hollow silica spheres of controlled size and porosity by sol-gel processing," J. Am. Ceram. Soc., 74:8, pp. 1987-1992, 1991.

Kim, K., "Fabrication of glass micro- and nanospheres from liquid precursors using droplet generation and sot-gel processing," Mat. Res. Soc. Symp. Proc., vol. 372, pp. 25-32, 1995.

Kim, K., et al., "Fabrication of hollow silica aerogel spheres by a droplet generation method and sol-gel processing," J. Vac. Sci, Technol. A., vol. 7, No. 3, pp. 1181-1184, 1989.

Kirwan, J.E., et at., "An experimental and theoretical study of a monodisperse spray," AIAA J. Propulsion and Power, vol. 4, No. 4, pp. 299-307, 1988.

Ko, J., et al., "Preparation and characterization of chitosan micropartides intended for controlled drug delivery," Int. J. Pharm. 249, 165-174, 2002.

Koizumi, Makoto, et al., "Allosteric selection of ribozymes that respond to the second messengers cGMP and cAMP," Nature Structural Biology, vol. 6, pp. 1062-1071, 1999.

Leach, K.J., et al., "Degradation of double-walled polymer microspheres of PLLA and P(CPP:SA) 20:80. I. In vitro degradation," 1973-1980, 1998.

Leach, K.L., et al., "Degradation of double-walled polymer microspheres of PLLA and P(CPP:SA) 20:80 II in vivo degradation," Biomaterials, 19:1981-1988, 1998.

Lee, T.H., et al., "Double-walled microspheres for the sustained release of a highly water soluble drug: characterization and irradiation studies," J. Controlled Release, 83:437-452, 2002.

Leelarasamee, N. et al., "A method for the preparation of polylactic acid microcapsules of controlled particle size and drug loading," Journal of Microencapsulation 5, 147-157, 1988.

Loscertales, I.G., et al., Micro-nano encapsulation via electrified coaxial liquid jets, Science, 295, pp. 1695-1698, (2002).

Mok, L.S. et al., "Equilibrium of a liquid in a spherical shell due to gravity, surface tension, and van der Walls forces," Phys. Fluids, vol. 28, No. 5, pp. 1227-1232, May 1985.

Reyderman, L. et al., "Electrostatic spraying and its use in drug delivery—cholesterol microspheres," Int. J. Pharm. 124, 75-85, 1995.

Sanchez, A. et al., "Pulsed controlled-release system for potential use in vaccine delivery," Pharm. Sci. 85, 547-552, 1996.

Sansdrap, P. et al., "Influence of manufacturing parameters on the size characteristics and the release profiles of nifedipine from poly(DL-lactide-co-glycolide) microspheres," Int. J. Pharm. 98, 157-164, 1993.

Santoro, Stephen, et al., "A general purpose RNA-cleaving DNA enzymes," Proceedings of National Academy of Science, vol. 94, pp. 4262-4266, 1997.

Shi, M., et al., "Double walled POE/PLGA microspheres: encapsulation of water-soluble and water-insoluble proteins and their release properties," J. Controlled Release, 89:167-177, 2003.

Shiga, K. N. Muramatsu et al., "Preparation of poly(D,L-lactide) and copoly(lactide-glycolide) microspheres of uniform size," J. Pharm,. Pharmacol 48, 891-895, 1996.

Skoog, D., et al., from Fundamentals of Analytical Chemistry, fourth edition, Section 3C-2, 51-53, 1982.

Tracy, M.A., "Development and scale-up of a microsphere protein delivery system," Biotechnol. Prog. 14, 108-115, 1998.

Yang, Y., et al., "POE/PLGA composite microspheres: formation and in vitro behavior of double walled microspheres," J. Controlled Release 88:201-213, 2003.

You, J. et al., "Preparation of regular sized ca-alginate microspheres using membrane emulsification method," Journal of Microencapsulation, vol. 18, No. 4, pp. 521-532, 2001.

International Search Report dated Jan. 30, 2003 for PCT application No. PCT/US2001/25674.

Utada, A.S., et al., "Monodisperse double emulsions generated from a microcapillary device", Science, vol. 308, pp. 537-541, (2005).

Groenendaal, L., et al., "Poly(3,4-ethylenedioxythiophene) and its derivatives: Past, Present, and Future", Advanced Materials, vol. 12, No. 7, pp. 481-494, (2000).

Schrauwers, A., "Focused spraying: Fighting plant disease without making a mess", Delft Outlook, pp. 1, 6-16, located at http://www.delftoutlook.tude1ft.nl/info/index.cfm?hoofdstuk=article &ArtID=5558, (2003).

International Search Report dated Apr. 6, 2006 for PCT application No. PCT/US2005/038995.

Kim, K. et al., "Generation of charged liquid cluster beam of liquid-mix precursors and application to nanostructured materials", Nanostructured Materials, vol. 4, No. 5, pp. 597-602, (1994).

* cited by examiner

ELECTROHYDRODYNAMIC SPRAYING SYSTEM

BACKGROUND

Electrohydrodynamic spraying has been used to process liquids into structures having sizes on the micrometer and nanometer scale. An electrohydrodynamic spraying apparatus applies a charging voltage to a liquid, resulting in an accumulation of repulsive electrostatic force within the liquid. When the repulsive electrostatic force exceeds the surface tension force, the surface of the liquid is disrupted to form small jets of liquid. These small jets then break up into streams of charged liquid clusters, which are referred to as "nanodrops" when the dimensions of the clusters are on the order of 100 nanometers (nm) or less.

Typically, nanodrops produced by electrohydrodynamic spraying are directed to the surface of a substrate material, which may be neutral or which may have an electric charge opposite that of the drops. If sufficient numbers of nanodrops accumulate on the substrate, the nanodrops will tend to coalesce and form a thin film. Nanodrops containing reactive material can be subjected to reaction conditions such that the nanodrops are converted into nanoparticles. Nanodrops also may be converted into nanoparticles by directing the nanodrops into a flask containing an appropriate liquid. For example, nanodrops containing a polymer can be converted into nanoparticles if the liquid in the flask is a nonsolvent for the polymer.

A specific example of electrohydrodynamic spraying is the Charged Liquid Cluster Beam (CLCB) technique. In CLCB, the electrostatic charge is injected into the liquid by a sharp, high-voltage electrode immersed in the liquid, where the liquid flows past the electrode and through a spray nozzle. The resulting nanodrops can then be directed to a substrate material. The size of the nanodrops is strongly dependent on the voltage applied to the electrode and on the flow rate of the liquid past the electrode. Modification of temperature gradients between the liquid and the spray nozzle and between the spray nozzle and the substrate can provide control over the final nanostructure formed on the substrate. Typical nanostructures include nanodrops, nanoparticles, and thin films. For thin film structures, all of these processing parameters also can be adjusted to control the morphology of the thin film, such as the size and shape of the film, the thickness of the film, and any variations or gradients in the thickness of the film.

Electrohydrodynamic spraying techniques, including CLCB, typically have been limited to use with substrates having a surface area less than 10 square centimeters ($cm^2$). The electrostatic repulsion between the liquid jets tends to configure the spray from the nozzle in the shape of a cone. If the target surface area is too large and/or if the distance between the spray nozzle and the substrate is too great, the spray cone will tend to spread out and form a ring on the substrate. Electrostatic repulsion between nanodrops formed from an individual liquid jet can further contribute to the non-uniformity of the film, leading to an overall morphology of a ring made up of circular patches of nanodrops. In addition to limiting the sizes of films produced, these disadvantages can also hinder the adjustment of an electrohydrodynamic spraying apparatus to accommodate different materials or applications. For example, the distance between the spray nozzle and the substrate cannot be changed without affecting the morphology of the deposited nanodrops and the resulting thin film.

It is thus desirable to provide an electrohydrodynamic spraying system that can deposit a uniform thin film onto a substrate over a relatively large area. It is also desirable that such a system would be capable of adjustment so as to provide films having varying morphologies.

BRIEF SUMMARY

In a first embodiment of the invention, there is provided an electrohydrodynamic spray apparatus, comprising a liquid inlet; a spray nozzle in fluid communication with the liquid inlet, the spray nozzle comprising an opening downstream of the liquid inlet; an inner electrode at least partially inside the spray nozzle; and an outer electrode external to the spray nozzle, and within 100 mm of the opening.

In a second embodiment of the invention, there is provided an electrohydrodynamic spray system, comprising an electrohydrodynamic spray apparatus having a liquid inlet; a spray nozzle in fluid communication with the liquid inlet, the spray nozzle comprising an opening downstream of the liquid inlet; an inner electrode at least partially inside the spray nozzle; and an outer electrode external to the spray nozzle, and within 100 mm of the opening; and a substrate positioned downstream of the spray nozzle.

In a third embodiment of the invention, there is provided a method of making nanostructures, comprising introducing a liquid into a spray nozzle comprising an opening; applying a charging voltage to the liquid; forcing the liquid through the opening of the spray nozzle to form a liquid spray; applying an electric field to the liquid in close proximity to the opening of the spray nozzle; and collecting the liquid spray on a substrate.

BRIEF DESCRIPTION OF THE DRAWINGS

Many of the features and dimensions portrayed in the drawings, and in particular the presentation of layer thicknesses and the like, and the spacing there between, have been somewhat exaggerated for the sake of illustration and clarity.

DETAILED DESCRIPTION

An electrohydrodynamic spray apparatus includes a liquid inlet, a spray nozzle in fluid communication with the liquid inlet, an inner electrode, and an outer electrode. The spray nozzle has an opening through which a liquid, introduced through the liquid inlet, is sprayed. The inner electrode is at least partially inside the spray nozzle, and the outer electrode is external to the spray nozzle, within about 100 millimeters (mm) of the opening. The electrohydrodynamic spray apparatus can provide a thin film having a uniform thickness over a large area.

In a first aspect of the invention, an electrohydrodynamic spray apparatus includes a liquid inlet, a spray nozzle in fluid communication with the liquid inlet, an inner electrode at least partially inside the spray nozzle, and an outer electrode external to the spray nozzle. The spray nozzle has an opening downstream of the liquid inlet, and the outer electrode is positioned within 100 mm of the opening.

In a second aspect of the invention, an electrohydrodynamic spray system includes an electrohydrodynamic spray apparatus and a substrate. The electrohydrodynamic spray apparatus has a liquid inlet, a spray nozzle in fluid communication with the liquid inlet, an inner electrode at least partially inside the spray nozzle, and an outer electrode external to the spray nozzle. The spray nozzle has an opening downstream of the liquid inlet, and the outer electrode is positioned within about 100 mm of the opening. The substrate is positioned downstream of the spray nozzle.

In a third aspect of the invention, a method of making nanostructures includes introducing a liquid into a spray nozzle having an opening, applying a charging voltage to the liquid, forcing the liquid through the opening of the spray nozzle to form a liquid spray, applying an electric field to the liquid in close proximity to the opening of the spray nozzle, and collecting the liquid spray on a substrate.

Figure 1:
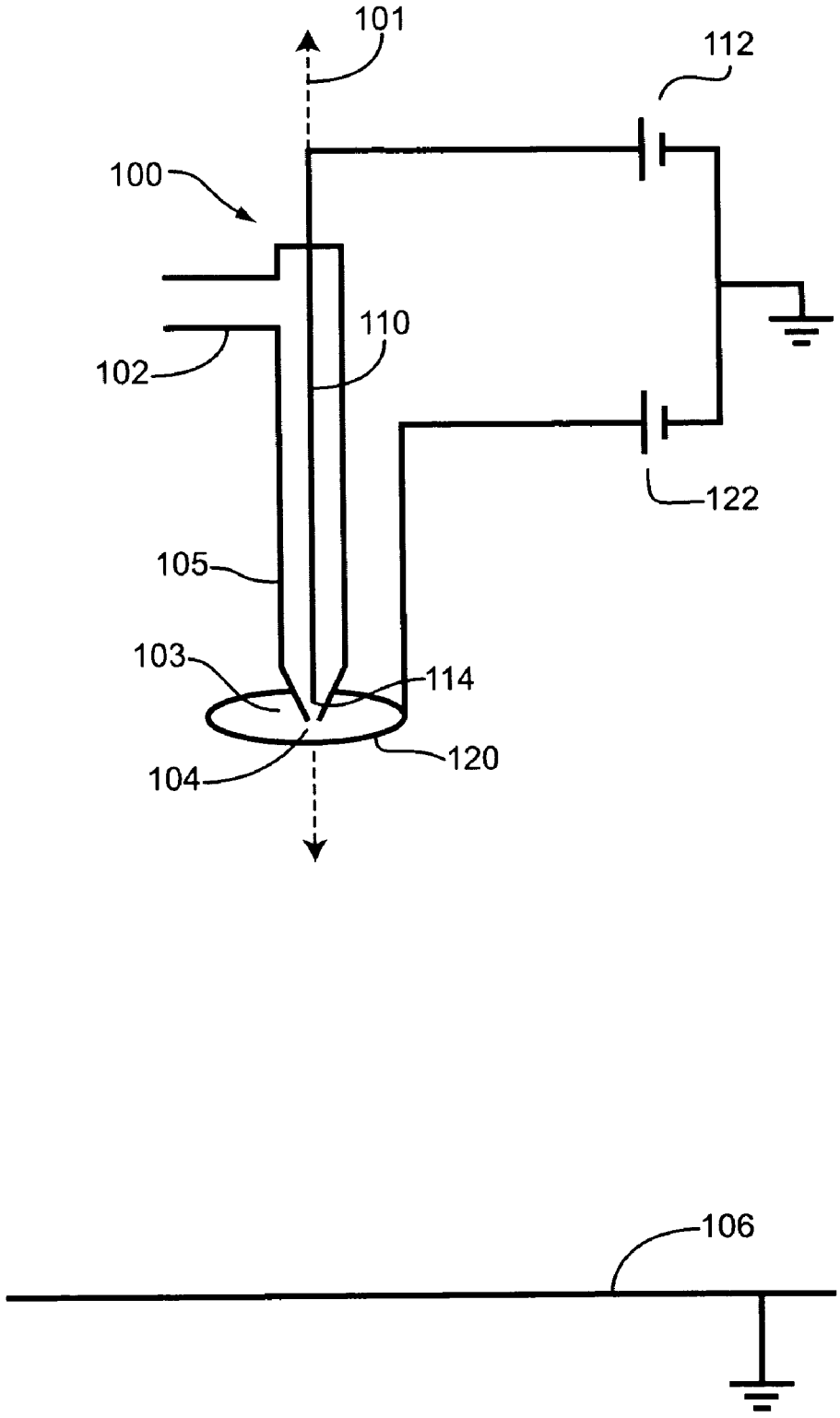
FIG. 1 is a schematic illustration of a cross-sectional view of an electrohydrodynamic spray apparatus.
Figure 2:
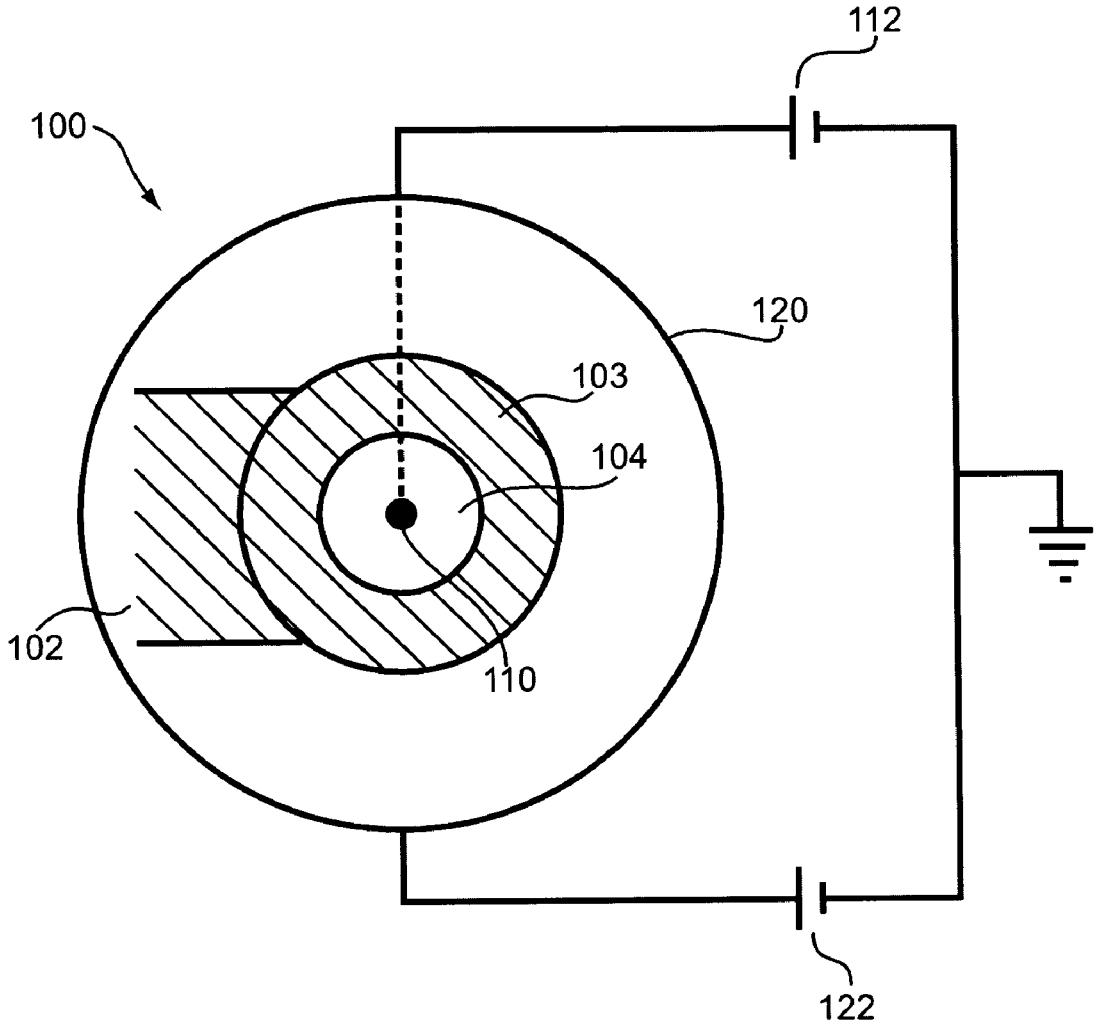
FIG. 2 is a schematic illustration of an end view of the apparatus of FIG. 1.

An example of an electrohydrodynamic spray apparatus is shown schematically in FIGS. 1-2. Spray nozzle 100 is in fluid communication with liquid inlet 102, to allow a liquid to be fed through the opening 104 and onto substrate 106. An inner electrode 110 is at least partially inside the spray nozzle and is connected to a first voltage source 112. An outer electrode 120 is external to the spray nozzle and is connected to a second voltage source 122. Application of the appropriate voltages to the inner and outer electrodes produces a spray of nanodrops from the nozzle onto the substrate.

The nozzle 100 may have any enclosed shape, provided there is an opening for the liquid inlet and an opening for the release of the liquid. In one example, the nozzle 100 is a simple tube. In another example, the nozzle 100 may have a reducing region 103 near the opening 104, with a tube 105 between the reducing region and the liquid inlet. The nozzle may be made of an electrically insulating material such as a polymer, glass or ceramic. The nozzle may also be made of a metal, which may be desirable for spraying at elevated temperatures.

The nozzle opening 104 may be substantially circular, or it may have other shapes. For example, the nozzle opening may be in the shape of an oval, a polygon (with sharp or rounded corners), or a slit. The size of the opening may be as small as possible, provided the liquid does not clog the opening. Practically, a lower limit on the size of the opening will be affected by the viscosity of the liquid, as liquids with higher viscosities will require larger openings in order to be sprayed at an acceptable flow rate. For a substantially circular opening, the inner diameter of the nozzle tube may be less than about 2.0 mm, preferably is from about 0.3 mm to about 2.0 mm, and more preferably is from about 0.4 mm to about 1.0 mm. If no reducing region is present, the inner diameter of the tube defines the size of the nozzle opening. The diameter of the opening in the optional reducing portion may be less than about 0.5 mm, preferably is from about 0.01 mm to about 0.5 mm, and more preferably is from about 0.10 mm to about 0.30 mm.

The inner electrode 110 may be any electrode capable of delivering charge to the liquid flowing through the spray apparatus. Preferably, the inner electrode is a solid conductive needle having a sharp point at the end 114. The inner electrode material may be any electrically conducting material and preferably is a metal. Specific examples of inner electrode materials include platinum, steel or tungsten. Preferably the maximum diameter of the inner electrode is less than half the diameter of the nozzle tube. Preferably the point at the end of the inner electrode has a diameter less than about 5 microns.

When sufficient voltage is applied to the inner electrode, the inner electrode serves as a continuous supply of field injection charge. This field injection charge causes the liquid present in the spray nozzle to become charged. The field injection likely occurs at the tip of the inner electrode, since a strong electric field can result from the small radius of curvature of the tip and the high voltage applied to the tip, typically about 10-20 kV. The charged liquid thus emerges from the opening of the nozzle in the form of a spray.

Figure 3:
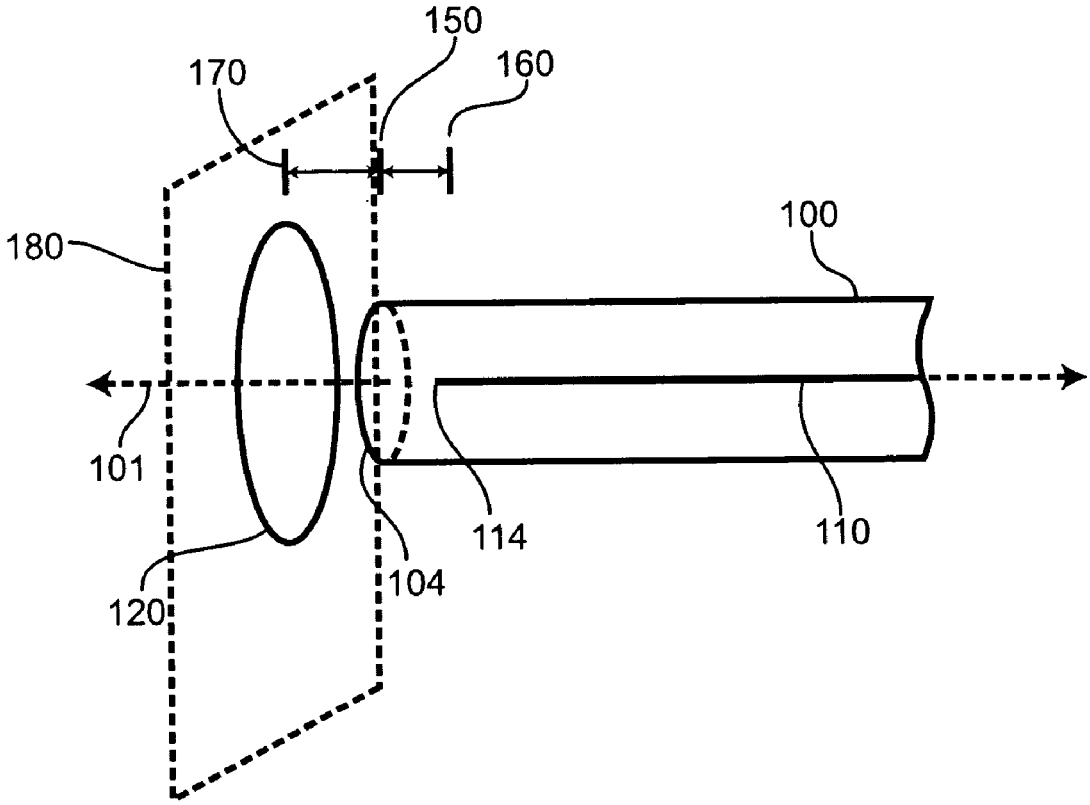
FIG. 3 is a schematic illustration of a spray nozzle.
Figure 4:
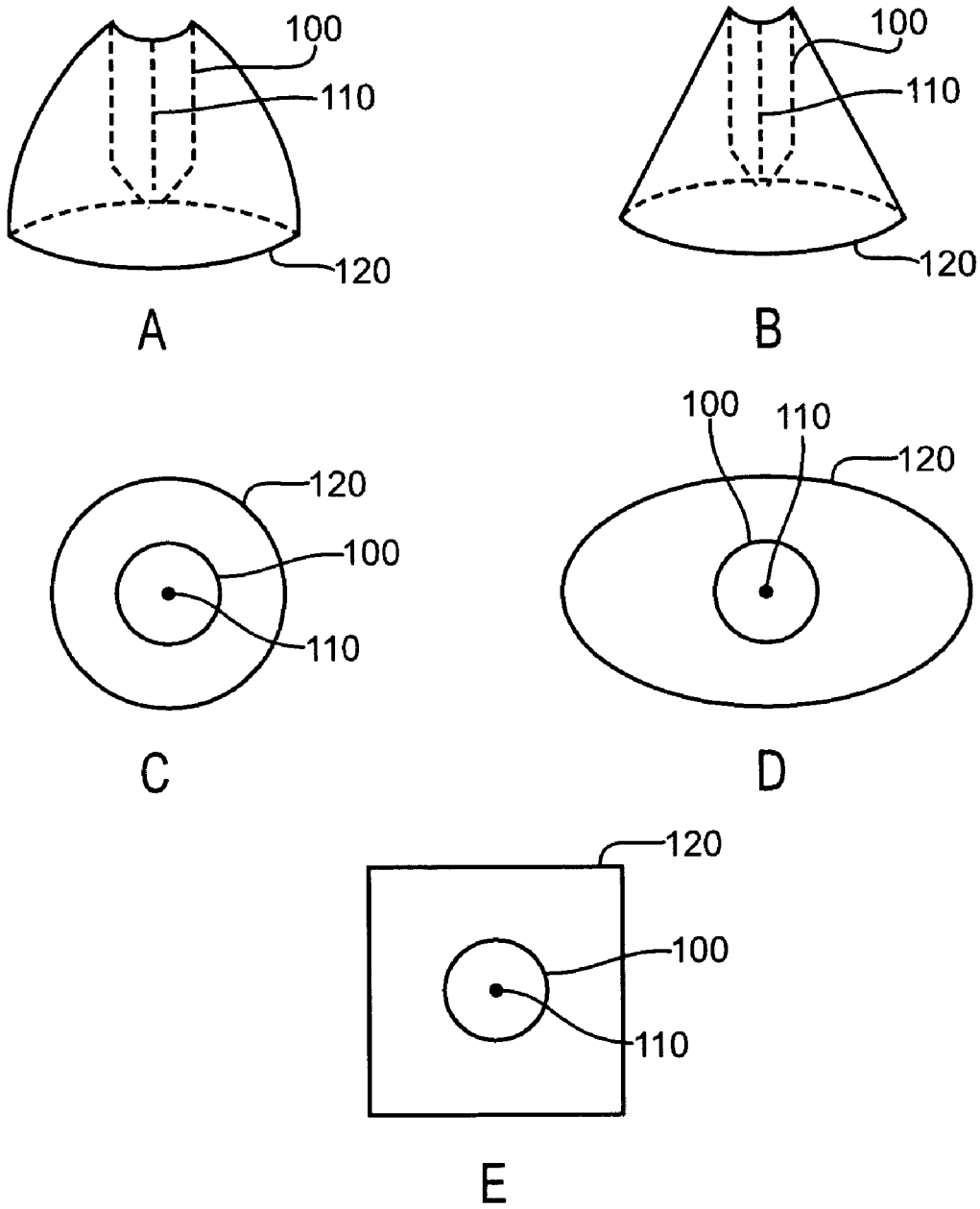
FIGS. 4A-4E are schematic illustrations of an electrohydrodynamic spray apparatus, illustrating exemplary configurations of the outer electrode.

Referring to FIG. 3, the end 114 of the inner electrode may have different positions relative to the opening 104 of the nozzle. For example, the end of the inner electrode may be positioned at the nozzle opening, at position 150. In another example, the end of the inner electrode may be positioned upstream of the nozzle opening, at position 160, such that the inner electrode is completely inside the nozzle. In another example, the end of the inner electrode may be positioned downstream from the nozzle opening, at position 170, such that the end of the inner electrode protrudes outside of the nozzle. The inner electrode may be positioned along the axis 101 of the nozzle, it may be positioned parallel to the axis of the nozzle, or it may be positioned at an angle relative to the axis of the nozzle. Preferably, the inner electrode is positioned along the axis of the nozzle.

Inner electrodes positioned completely inside the spray nozzle typically have longer lifetimes than inner electrodes that protrude past the opening. The optimal position for the inner electrode relative to the nozzle opening may depend on the properties of the liquid to be sprayed. Preferably, the end of the inner electrode is completely inside the nozzle and is from about 0 mm to about 10 mm from the nozzle opening. More preferably, the end of the inner electrode is completely inside the nozzle and is from about 0.5 mm to about 7.0 mm from the nozzle opening, more preferably from about 1.5 mm to about 4.0 mm from the nozzle opening.

The outer electrode 120 may be any electrode capable of applying an electric field to an area in close proximity to the opening of the spray nozzle. The outer electrode is electrically isolated from the inner electrode. The outer electrode material may be any electrically conducting material and preferably is a metal, such as platinum, steel or tungsten. The characteristics of the outer electrode can affect the uniformity of the spray produced. Examples of these characteristics include the shape, position, orientation, and size of the second electrode.

Figure 5:
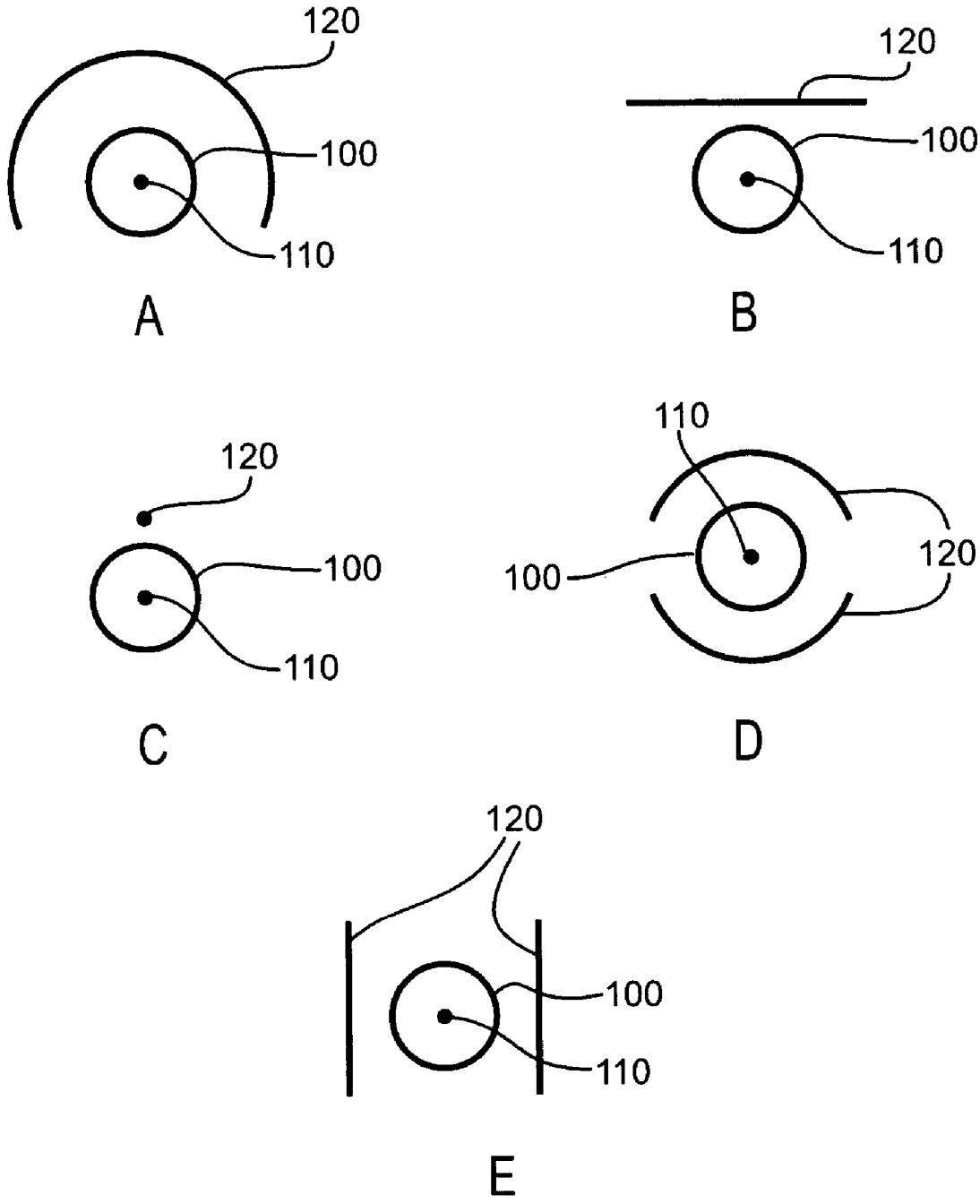
FIGS. 5A-5E are schematic illustrations of an electrohydrodynamic spray apparatus, illustrating exemplary configurations of the outer electrode.

The outer electrode may be configured as any closed or open geometrical shape, examples of which are illustrated in FIGS. 4A-4E and FIGS. 5A-5E. Possible configurations include, but are not limited to, a cup (FIG. 4A), a cone (FIG. 4B) a ring such as a circular ring (FIG. 4C) or an elliptical ring (FIG. 4D), a square (FIG. 4E), a semicircle (FIG. 5A), a line (FIG. 5B), or a point (FIG. 5C). The outer electrode may also be made of two or more separate electrode portions, which may be at the same voltage or at different voltages. For example, the outer electrode may be configured as two or more semicircles (FIG. 5D) or as two or more lines (FIG. 5E). Thus, the outer electrode may be configured in a closed geometrical shape (FIGS. 4A-4E) or in an open geometrical shape (FIGS. 5A-5E). For ease of description, the outer electrode is illustrated in the other Figures herein as a circular ring; however, any of the spray nozzles described may be used with a non-circular outer electrode.

Referring again to FIG. 3, the outer electrode 120 may have different positions relative to the opening 104 of the nozzle. For example, the outer electrode may be positioned at the nozzle opening, at position 150. In another example, the outer electrode may be positioned before the nozzle opening, at position 160. In another example, the outer electrode may be positioned past the nozzle opening, at position 170. The outer electrode may be oriented such that the nozzle axis 101 is normal to the plane 180 of the outer electrode, or it may be oriented such that the nozzle axis is at an angle relative to the plane of the outer electrode. The outer electrode may also be non-planar. Since the outer electrode may be positioned downstream from the opening of the spray nozzle, it is possible that some spray loss may occur due to liquid impinging on the electrode. Thus, it may be desirable to minimize the thickness of the electrode. The outer electrode may be as thin as possible, provided the electrode can maintain its shape.

The shape and orientation of the outer electrode, among other parameters, can affect the symmetry of the spray produced by the apparatus. The more symmetrical the shape of the electrode, the more symmetrical will be the spray. For a symmetrically shaped outer electrode, the closer the nozzle axis is to a normal orientation relative to the plane of the electrode, the more symmetrical will be the spray. An outer electrode that is asymmetrically shaped and/or tilted with respect to the nozzle axis can be used to provide an asymmetric spray, which may be desirable in some applications.

With respect to the size of the outer electrode, the longest distance from one side of an outer electrode to another side of the outer electrode may be up to about 100 mm. For an outer electrode in the shape of a circular ring, cup or cone, this distance corresponds to the diameter of the electrode. The outer electrode may be as small as is allowed by the nozzle configuration. For example, if the outer electrode is upstream of the nozzle opening, the lower limit of the size of the outer electrode is determined by the outer diameter of the nozzle. Preferably the longest distance from one side of an outer electrode to another side of the outer electrode is from about 2 mm to about 100 mm, more preferably from about 7 mm to about 80 mm, more preferably from about 10 mm to about 70 mm.

Smaller dimensions for the outer electrode are desirable when multiple spray nozzles are used in combination, such as for large area spraying. For multiple spray nozzle systems, the size of the outer electrode is limited by the distance between adjacent nozzles. The outer electrodes in a multiple nozzle system may be electrically isolated, or they may be in electrical communication with each other. In one example, a single conducting plate, with holes sized and positioned to coordinate with the spray nozzles, can be used as the outer electrode. In this example, each hole functions as the outer electrode for its corresponding spray nozzle.

The position of the outer electrode relative to the nozzle can be quantified based on the distance from the electrode to the nozzle opening. For a circular ring, cup or cone outer electrode, the electrode may be upstream of the nozzle opening preferably by a distance of about 60% or less of the ring diameter, and may be downstream of the nozzle opening preferably by a distance of about 35% or less of the ring diameter. Preferably, the electrode is spaced from the nozzle opening, whether upstream or downstream, by a distance of about 20% or less of the ring diameter. For a cup, cone or ring electrode having a diameter from about 2 mm to about 100 mm, this position range approximately corresponds to a range of from about 50 mm upstream to about 30 mm downstream of the nozzle opening; preferably from about 30 mm upstream to about 20 mm downstream of the nozzle opening; more preferably from about 15 mm upstream to about 15 mm downstream. Practically, if the outer electrode is too far upstream, it will have minimal influence on the quality of the spray; and if the outer electrode is too far downstream, it will partially block the path of the spray and lead to spray loss.

One characteristic of the outer electrode that depends both on the size of the electrode and its position relative to the spray nozzle is the characteristic of the shortest distance between the outer electrode and the nozzle opening. The outer electrode is sized, positioned and oriented such that the electrode is less than about 100 mm from the nozzle opening. Preferably, the shortest distance between the opening and the outer electrode is from about 2 mm to about 50 mm . More preferably, the shortest distance between the opening and the outer electrode is from about 5 mm to about 45 mm; more preferably still from about 5 mm to about 30 mm.

The substrate 106 may be any material that can support the deposited nanodrops, nanoparticles, or thin film. The substrate may be electrically conductive, and may be grounded or held at an electric potential. An electrically grounded substrate can provide for dissipation of the charge on the deposited nanodrops. The substrate can also be connected to a voltage source. For example, if the substrate is held at a voltage that is of opposite polarity relative to the voltage of the inner and outer electrodes, the deposited nanodrops can be neutralized upon contact with the substrate. In some cases, it may be desirable for the substrate to have an opposite polarity relative to the inner and outer electrodes, as this can reduce the loss of spray to the areas surrounding the substrate. The substrate also may be non-conductive. For non-conductive substrates, the polarity of the charge of the nanodrops may be alternated from positive to negative during the spraying and deposition process, so as to allow for continued deposition of nanodrops on the substrate.

The spray apparatus and the substrate may be moveably positioned relative to each other, and the distance between the spray apparatus and the substrate can be varied widely. For a given set of spray conditions, including the configuration of the spray apparatus, the composition of the liquid, and the voltages applied to the inner and outer electrodes, the distance between the spray apparatus and the substrate can be adjusted to optimize the structure of the deposited spray. For covering larger areas with a spray of nanodrops, a larger distance between the spray apparatus and the substrate may be desirable. Preferably, the distance between the nozzle opening of the spray apparatus and the substrate is from about 5 centimeters (cm) to about 60 cm. More preferably, the distance between the nozzle opening of the spray apparatus and the substrate is from about 5 cm to about 40 cm, and even more preferably is from about 10 cm to about 30 cm.

The spray apparatus may have a variety of orientations relative to the substrate. For example, the substrate may be substantially horizontal, and the spray apparatus may be above the substrate and in a substantially vertical orientation. In another example, the substrate may be substantially horizontal, and the spray apparatus may be above the substrate and oriented at an angle that is not normal to the plane of the substrate. In another example, the spray apparatus may be positioned below the substrate, and may be normal or tilted with respect to the plane of the substrate. In another example, the substrate may be in a non-horizontal orientation, including a vertical orientation. Within this example, the spray apparatus may be normal or may be tilted with respect to the plane of the substrate.

The liquid used in the electrohydrodynamic spray apparatus can be any liquid capable of being sprayed and also capable of being charged by an immersed electrode. The liquid may be a single substance, or it may be a mixture of substances, such as a solution, a colloid, or a dispersion. Liquid mixtures typically include a solvent and one or more other substances dissolved or dispersed in the solvent. More than one solvent may be present in addition to the dissolved or dispersed substance. Examples of common solvents include water, methanol, ethanol, acetone, isopropanol, chloroform, toluene, xylene, and tetrahydrofuran.

Electrohydrodynamic spraying may be used to form nanostructures of a substance that is dissolved or suspended in the solvent. For example, a liquid containing a solvent and a polymer dissolved or dispersed in the solvent can be sprayed onto a substrate to form a film of the polymer. In another example, a liquid containing a solvent, a dissolved or dispersed polymer, and a particulate substance can be sprayed onto a substrate to form a polymeric film containing a uniform distribution of the particulate substance. Examples of particulate substances include particles of metals, semiconductors, catalysts, and bioactive agents.

Electrohydrodynamic spraying also may be used to form nanostructures of reaction products of one or more substances that are dissolved or suspended in the solvent. For example, a liquid containing a solvent and one or more reactants dissolved or dispersed in the liquid can be sprayed onto a substrate and subjected to appropriate reaction conditions. Examples of reactants useful for preparing structures of metallic or inorganic substances include the metal-trifluoroacetates, metal-ethoxides, and silicon tetraethoxide as disclosed in U.S. Pat. No. 5,344,676, which is incorporated herein by reference.

The electrohydrodynamic spray apparatus having both an inner electrode and an outer electrode can be used to produce a substantially uniform spray of liquid nanodrops. When the inner electrode is electrically neutral, liquid introduced into the liquid inlet preferably does not flow through the opening of the nozzle, due to the surface tension of the liquid. Application of sufficient voltage to the inner electrode can inject charge into the liquid, causing the charged liquid to spray out of the nozzle opening. Application of an appropriate voltage to the outer electrode can provide for a uniform spray of nanodrops on the substrate.

The voltages applied to the inner and outer electrode can be selected based on considerations such as the configuration of the spray apparatus and substrate, the type of material used for the substrate, the composition of the liquid, and the desired application for the nanostructures and/or the coated substrate. Preferably, the value of the voltage applied to the outer electrode is between the value of the voltage applied to the inner electrode and the value of the voltage applied to the substrate. Examples of combinations of voltages include the following:

- inner electrode at 20 kV, outer electrode at 10 kV, and substrate at 0 V;
- inner electrode at 10 kV, outer electrode at 0 V, and substrate at −10 kV;
- inner electrode at 5 kV, outer electrode at −6 kV, and substrate at −15 V;
- inner electrode at −5 kV, outer electrode at 6 kV, and substrate at 15 V;
- inner electrode at −10 kV, outer electrode at 0 V, and substrate at 10 kV; and
- inner electrode at −20 kV, outer electrode at −10 kV, and substrate at 0 V.

For a given voltage applied to the inner electrode, the voltage applied to the outer electrode can be varied until the spray and/or the nanostructure(s) on the substrate have the desired distribution and dimensions. Likewise, the voltage applied to the outer electrode can be held constant, and the voltage applied to the inner electrode can be varied to optimize the process. The applied voltage can have negative or positive polarity. The inner and outer electrodes may have the same polarity of applied voltage, or they may have opposite polarities. Preferably the inner and outer electrodes have the same polarity of the applied voltage.

The electrohydrodynamic spray apparatus having both an inner electrode and an outer electrode can provide a spray of nanodrops that is more uniform than that produced by an equivalent electrohydrodynamic spray apparatus having only an inner electrode. This increased uniformity can allow for large areas to be covered with a more uniform distribution of nanodrops. Single-electrode spray apparatus having only an inner electrode typically have been limited to use with substrates having a surface area less than 10 $cm^2$, since the spray tends to form a ring on the substrate rather than a uniformly coated area.

Large area substrates can be covered with a uniform distribution of nanodrops by moving the spray apparatus and substrate with respect to each other. Thus, the spray can be continually applied to an area of the substrate that has not yet been contacted with nanodrops. The spray uniformity may be improved further by rotating and/or oscillating the spray apparatus with respect to the substrate. The relative motion of the spray apparatus and the substrate can be accomplished by moving the spray apparatus, moving the substrate, or by moving both the spray apparatus and the substrate at the same time. The rotation and/or oscillation can serve to average out any slight non-uniformity in the spray, so that the overall distribution is uniform. The spray uniformity may also be improved further by employing multiple spray apparatus, and these multiple spray apparatus can be rotated and/or oscillated with respect to the substrate.

Non-conducting substrates and electrically floating substrates may also be covered with a uniform distribution of nanodrops. For example, both positively and negatively charged nanodrops can be applied, either simultaneously or in alternating sequence. In one example, a combination of one or more spray apparatus producing positively charged nanodrops can be combined with one or more spray apparatus producing negatively charged nanodrops. Such a configuration is especially suited for uniformly coating substrates that have azimuthal symmetry. The rotation and/or oscillation of the substrate with respect to the spray apparatus can serve to maintain the charge neutrality in case of non-conducting substrates. Such a rotation and/or oscillation may also serve to average out any slight non-uniformity in the spray. In another example, the voltages applied to a spray apparatus can be alternated between positive and negative polarity. In this configuration, the inner and outer electrodes can have the same or opposite polarities initially, and then these respective polarities can be simultaneously alternated. For example, one or more spray apparatus can be configured such that the inner electrodes and outer electrodes are all positive initially and are then simultaneously cycled between positive and negative polarity. Also, a spray apparatus may initially have a positive inner electrode and a negative outer electrode, and these can be simultaneously reversed such that the inner electrode is negative and the outer electrode is positive.

Figure 11:
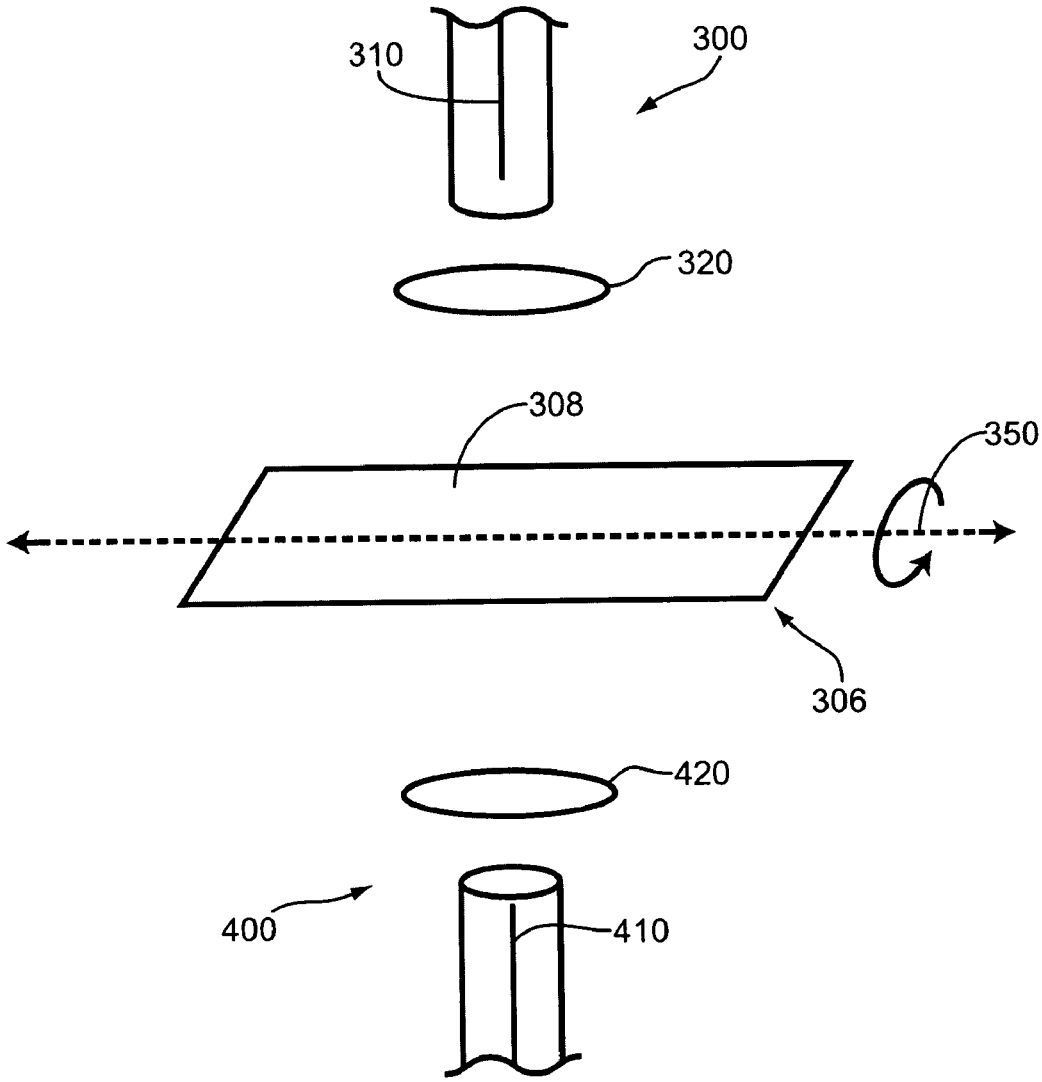
FIG. 11 is a schematic illustration of an electrohydrodynamic spray system containing two spray apparatus operating at opposite polarities.

In another example, charge neutrality can be maintained by rotating and/or oscillating one or more spray apparatus of one polarity with respect to one or more spray apparatus of the opposite polarity. In yet another example, one or more spray apparatus of one polarity can be can be positioned on the opposite side of the substrate from one or more spray apparatus of the opposite polarity. As shown in FIG. 11, spray apparatus 300, having one polarity, and spray apparatus 400, having the opposite polarity, are on opposite sides of substrate 306. Preferably the voltages of the electrodes are either 310>320>420>410 or 410>420>320>310. The substrate is downstream of each of the spray apparatus. The substrate can be rotated about axis 350, such that substrate surface 308 is contacted by liquid sprays having charges of opposite polarity in alternating succession.

Figure 6:
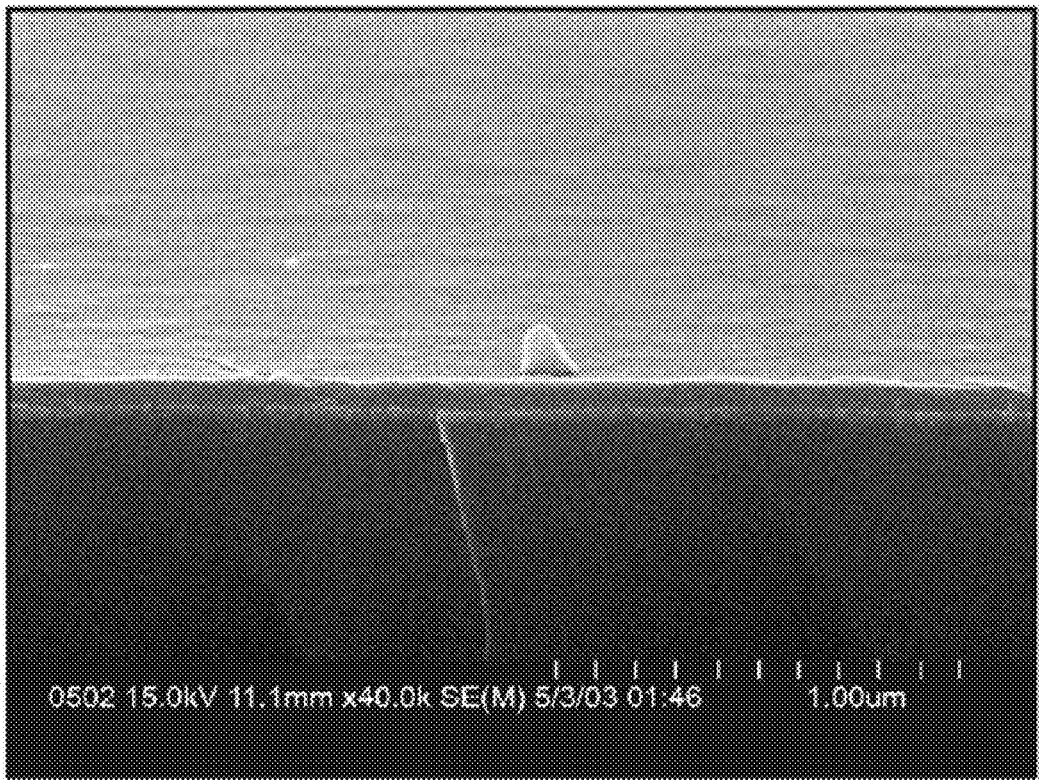
FIG. 6 is a scanning electron microscopy (SEM) micrograph of a polymeric thin film on a substrate.
Figure 7:
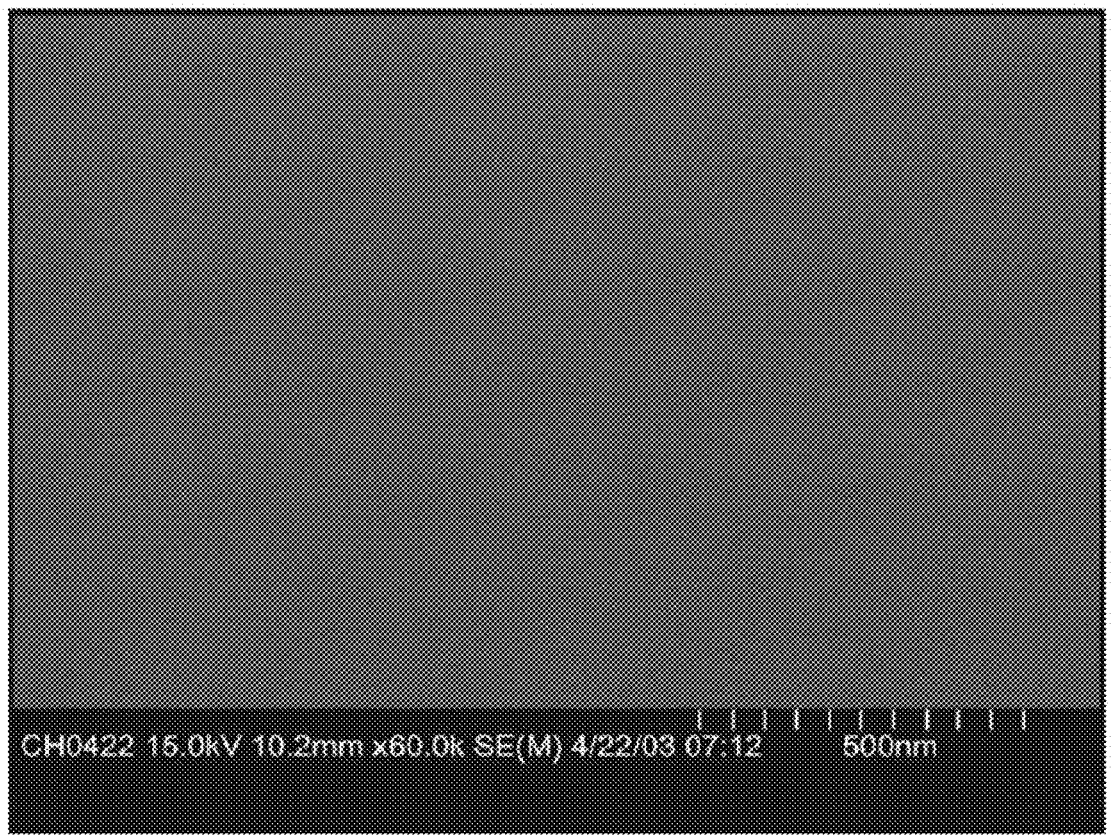
FIG. 7 is an SEM micrograph of a polymeric thin film on a substrate.

FIGS. 6 and 7 are scanning electron microscopy (SEM) micrographs of polymeric thin films on a substrate. These films were produced by spraying a mixture of a polymer blend in a solvent with an electrohydrodynamic spray apparatus having an inner electrode and an outer electrode. The thin films were deposited over areas of 5 cm×5 cm. The average thickness of each film was 100 nm, with a thickness variation over the entire film of 15%.

The two-electrode apparatus is also much more versatile than a single-electrode apparatus, since the properties of the spray can be adjusted by changing the voltages applied to the inner and/or outer electrodes and/or by changing the difference between these two applied voltages. Thus, a two-electrode apparatus can be used with a variety of different liquids and a variety of substrates, and can be configured to provide nanostructures for a variety of applications. These variations can be accommodated by changing the voltages in the inner and/or outer electrodes. These variations can also be accommodated by changing the configuration of an electrode with respect to the spray nozzle and/or with respect to the other electrode. These variations can also be accommodated by changing the configuration of the spray apparatus with respect to the substrate.

A number of parameters of the electrohydrodynamic spray system can be changed in order to optimize the properties of the spray and of the resulting nanostructures. As noted above, the configurations of the electrodes, spray nozzle and substrate can all be adjusted readily, as can the electrical potential of the electrodes and the substrate. Additional parameters that can be adjusted include the composition of the liquid, the temperature, and the chemical composition of the atmosphere surrounding the spray system.

The composition of the sprayed liquid can be varied to produce products including thin films, solid nanoparticles, porous nanoparticles, nanowires, and nanofibers. Solid nanoparticles may be obtained by allowing the solvent to evaporate before the spray contacts the substrate. This can be achieved, for example, by spraying in a high temperature environment and/or by increasing the distance between the spray apparatus and the substrate. In addition, solvents having a lower boiling point will evaporate more rapidly in a given environment. Nanoparticles can be porous or non-porous, and this morphology can be changed by modifying the concentration and type of solvent in the liquid. In general, more rapid evaporation of the solvent provides a more porous nanoparticle, so that porous particles are provided by using lower boiling solvents and/or lower concentration of solvent in the liquid. Higher temperatures can also provide for more porous nanoparticles. Dense nanoparticles can be obtained by solvent evaporation that is slower, but that is still complete before the spray contacts the substrate.

Solid thin films may be obtained by allowing some level of solvent to be present in the spray when the nanodrops contact the substrate. The presence of solvent can allow the nanodrops to coalesce, forming a continuous layer of material on the substrate. Evaporation of the solvent from the layer provides a solid thin film. More rapid evaporation tends to provide for films that are less dense or even porous. As with the formation of nanoparticles, evaporation is more rapid with lower boiling solvents and higher temperatures. The temperature of the substrate, in addition to the temperature of the surrounding atmosphere, can be adjusted so as to control the evaporation.

Structures such as nanowires or nanofibers can be formed if the spray that contacts the substrate has a high viscosity, inhibiting its spread across the surface. This high viscosity may exist in the liquid as it is fed into the system. This high viscosity may also be provided by an increase in the viscosity of the liquid after it has been sprayed. For example, evaporation of solvent and/or chemical reaction within the nanodrops can cause an increase in the viscosity of the liquid between the spray nozzle and the substrate.

In addition to controlling evaporation rates, the temperature of the electrohydrodynamic spray system can change other properties of the spray and the resulting nanostructures. For example, the temperature of the liquid before it is sprayed can affect the properties of the liquid, including surface tension, viscosity, dielectric constant and conductivity. Modification of the liquid temperature can allow the use of liquids that could not be sprayed at ambient conditions. The environmental temperature surrounding the spray can also be controlled so as to allow chemical reactions to occur within the nanodrops. Chemical reactions can occur between components in the liquid, and can optionally include gaseous reactants present in the environment. The nanodrops may also undergo chemical reactions once they are on the substrate, and these reactions can be affected by the temperature of the substrate. Temperature gradients between the spray apparatus and the substrate can also be used to provide control over evaporation, chemical reactions, and the fluid properties of the liquid.

The chemical composition of the atmosphere surrounding the spray can affect the spray and the resulting nanostructures. For example, the atmosphere may contain gaseous reactants, such as oxygen, ozone, nitrogen, or HCl. A gaseous reactant can react with substances in the liquid to form the final product forming the nanostructure. In this example, the reaction rate may be controlled by changing the partial pressure of the gaseous reactant. In another example, the atmosphere may contain a vapor of one or more solvents present in the liquid, so as to reduce the rate of evaporation from the nanodrops. In yet another example, a partial vacuum may be used to increase the rate of evaporation from the nanodrops. In yet another example, the atmosphere may be modified to allow higher voltages without electrical breakdown and arcing in the atmosphere.

Chemical reactions within liquid nanodrops can also occur due to interaction of the nanodrop with another liquid or with a solid. For example, two or more different liquids may be sprayed toward the same substrate. The ingredients in these liquids can interact due to collisions of the nanodrops, or by mixing of the liquids once the nanodrops are on the subsbtrate. If two different liquids are used, the rate of collision of the nanodrops, and the resultant mixing or reacting of the ingredients, can be increased by imparting opposite polarities on the two sprays. In another example, the ingredients in the liquid may react with the substrate itself and/or with a substance that is present on the substrate.

Patterns of nanostructures can be formed using the electrohydrodynamic spray system having an inner electrode and an outer electrode. A mask can be positioned between the spray apparatus and the substrate to prevent the deposition of nanodrops in the areas of the substrate covered by the mask. The resolution of the pattern can be affected by changing the distance between the mask and the substrate and/or by applying a voltage to the mask. The mask and the substrate can be held at the same electrical potential or at different electrical potentials. Thus, the dimensions of a pattern can be changed by using a single mask and varying the spray conditions. In one example, an array of pixels can be formed on a substrate, such as could be useful for a display device.

Wire masks made of stainless steel, tungsten, carbon fiber, or any other tough, corrosion resistant material may be useful for forming patterns of nanodrops. The mask may be made of a conducting or a non-conducting material. A wire mask can be made by stretching out an array of wire across a rigid frame, and then maintaining the tension on the wire. Parallel wires can serve as masks for line patterns as thin as 1 micron. Placing two sets of parallel wires at 90° can provide a pattern of rectangles, which can serve as an excellent mask for in-situ deposition of pixel layers in display devices. Examples of patterned films on a substrate are shown in the optical micrograph of FIG. 8 and the SEM micrograph of FIG. 9. These films were produced by spraying a mixture of a polymer blend in a solvent with an electrohydrodynamic spray apparatus having an inner electrode and an outer electrode. A wire mask having two sets of parallel wires at 90° was placed between the spray apparatus and the substrate.

EXAMPLES

Example 1

Two-Electrode Spray Apparatus

Figure 10:
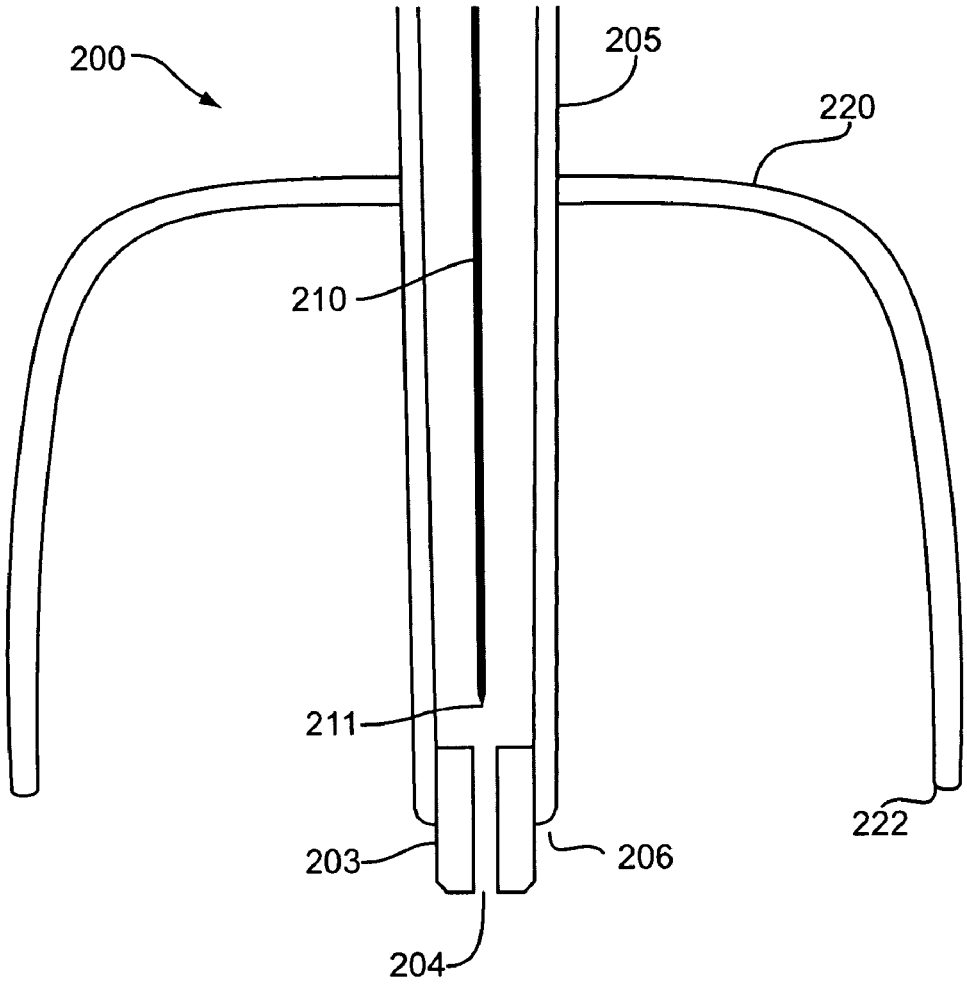
FIG. 10 is a schematic illustration of a cross-sectional view of an electrohydrodynamic spray apparatus.

An electrohydrodynamic spraying system was constructed having a spray nozzle, an inner electrode, an outer electrode, and a substrate. The spray nozzle contained a liquid inlet and a tubular polypropylene portion. The substrate was positioned normal to the spray nozzle, and at a distance of 200 mm from the nozzle opening. Referring to FIG. 10, the inner diameter of the polypropylene tube 205 at its opening 206 downstream of the liquid inlet was 0.6 mm. At this downstream opening, a tubular, reducing glass insert 203 was stationed inside the polypropylene tube. The inner diameter of the reducing insert was 0.14 mm, and the length of the insert was 2 mm, with 1 mm of the insert in contact with the inner surface of the main tube. The downstream opening 204 of the reducing insert served as the opening for the nozzle 200. The inner electrode 210 was a tungsten needle, having a diameter of 125 microns and having a point 211 with a diameter of less than 1 micron. The point of the inner electrode was 3 mm upstream of the downstream opening of the reducing insert. The outer electrode 220 was in the shape of a cup having a diameter of 9 mm and a thickness of 1.6 mm. The distance between the downstream rim 222 of the cup and the nozzle opening was a variable parameter.

Example 2

Variation of Voltage on Inner and Outer Electrodes

An electrohydrodynamic spraying system was used to spray a liquid mixture on a substrate. The liquid mixture contained a polymer mixture and a solvent mixture. The polymer mixture was a 1:20 blend of poly(3,4-ethylenedioxythiophene) and poly(styrenesulfonate), suspended in water at a 2.85 wt % solids content, available as BAYTRON P VP CH8000 (H.C. Starck; Newton, Mass.). The solvent mixture was 20:1 isopropyl alcohol and diethylene glycol, and the polymer was mixed with the solvent mixture for an overall composition of 1:20:1 of polymer mixture, isopropyl alcohol, and diethylene glycol. The liquid was passed through an electrohydrodynamic spray nozzle at a rate of 20 microliters per minute. The electrohydrodynamic spraying system was similar to that described in Example 1, except that the outer electrode was a ring having a diameter of 51 mm. The outer electrode was positioned 7.5 mm downstream of the nozzle opening. The substrate was a grounded metal plate.

A number of spray conditions were examined using this spraying system. In each investigation, the applied voltage was held constant on the outer electrode, and the applied voltage was then varied on the inner electrode. For an applied voltage of 10 kV on the outer electrode, a voltage on the inner electrode from 13.5-22 kV provided a stable spray and a uniform distribution of the spray on the substrate. For an applied voltage of 12.5 kV on the outer electrode, a voltage on the inner electrode from 15.5-25 kV provided a stable spray and a uniform distribution of the spray on the substrate. For an applied voltage of 15 kV on the outer electrode, a voltage on the inner electrode from 18-27 kV provided a stable spray and a uniform distribution of the spray on the substrate. For an applied voltage of 17.5 kV on the outer electrode, a voltage on the inner electrode from 20-29 kV provided a stable spray and a uniform distribution of the spray on the substrate. For an applied voltage of 20 kV on the outer electrode, a voltage on the inner electrode from 22.5-30 kV provided a stable spray and a uniform distribution of the spray on the substrate.

Example 3

Formation of Thin Film

An electrohydrodynamic spraying system was used to spray a liquid mixture on a substrate. The liquid mixture was identical to that used in Example 2. The liquid was passed through an electrohydrodynamic spray nozzle at a rate of 20 microliters per minute. The electrohydrodynamic spraying system was identical to that described in Example 1. The substrate was indium tin oxide (ITO) coated glass. A voltage of 20 kV was applied to the inner electrode, and a voltage of 12 kV was applied to the outer electrode.

FIG. 6 shows an SEM micrograph of a polymer film on the substrate, observed at an angle of 45 degrees. This film was deposited by spraying the liquid for 75 minutes. The outer electrode was positioned completely upstream of the nozzle opening, such that the distance between the downstream rim of the cup and the nozzle opening was 5.5 mm.

FIG. 7 shows an SEM micrograph of a polymer film on the substrate, observed at an angle of 45 degrees. This film was deposited by spraying the liquid for 50 minutes. The outer electrode was positioned completely upstream of the nozzle opening, such that the distance between the downstream rim of the cup and the nozzle opening was 6.5 mm.

Example 4

Formation of Patterns

An electrohydrodynamic spraying system was used to spray a liquid mixture on a substrate, where a mask was positioned between the spray apparatus and the substrate. The liquid mixture was identical to that used in Example 2, except that no diethylene glycol was present. The liquid was passed through an electrohydrodynamic spray nozzle at a rate of 20 microliters per minute. The electrohydrodynamic spraying system was identical to that described in Example 1. The substrate was indium tin oxide (ITO) coated glass. A voltage of 20 kV was applied to the inner electrode, and a voltage of 12 kV was applied to the outer electrode. The mask was a wire mask having two sets of parallel wires at 90°.

Figure 8:
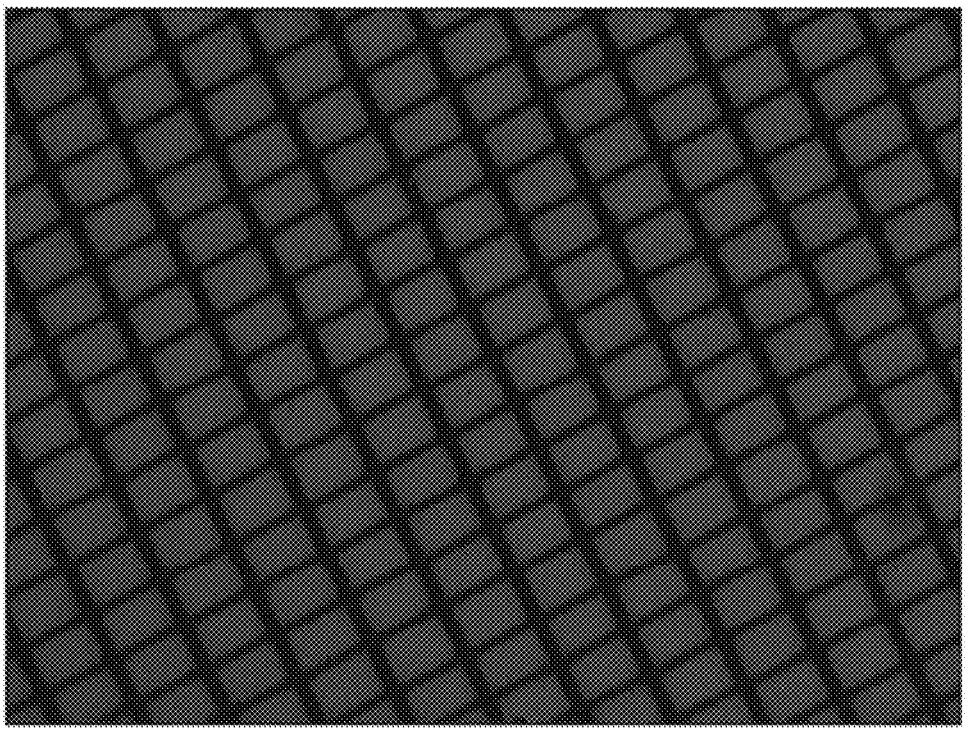
FIG. 8 is an optical micrograph of a patterned thin film of nanoparticles on a substrate.
Figure 9:
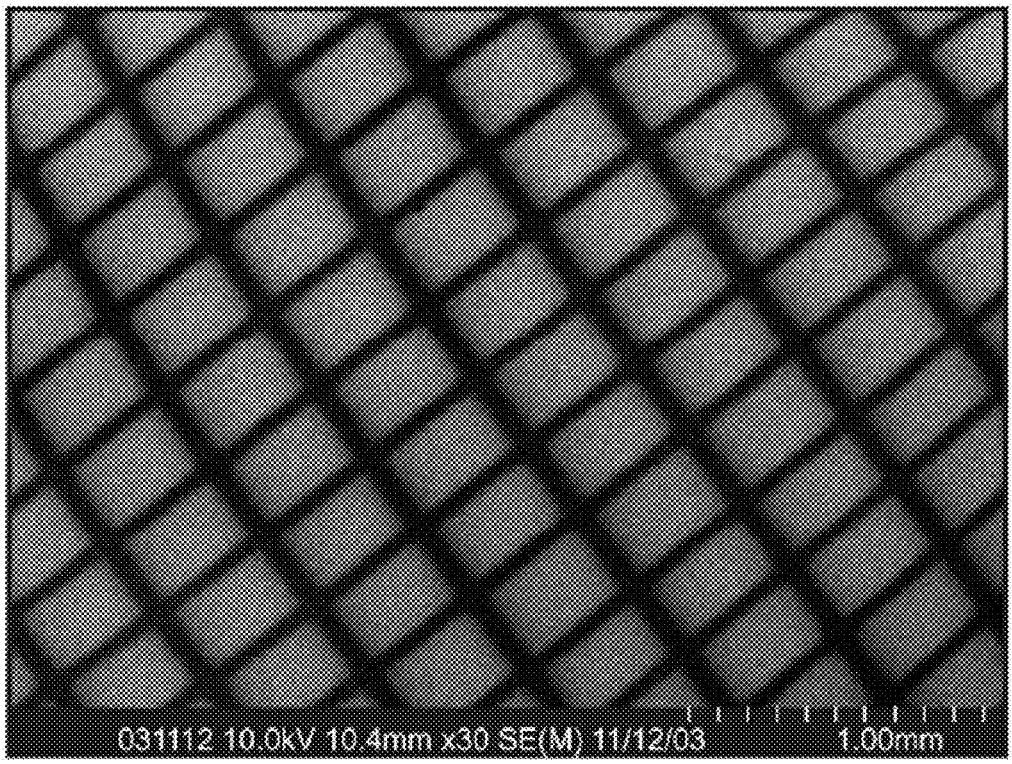
FIG. 9 is an SEM micrograph of the film of FIG. 8.

FIG. 8 shows an optical micrograph of a patterned film of polymer nanoparticles on the substrate, observed normal to the substrate. This film was deposited by spraying the liquid for 75 minutes. The outer electrode was positioned completely upstream of the nozzle opening, such that the distance between the downstream rim of the cup and the nozzle opening was 5.5 mm. FIG. 9 shows an SEM micrograph of the same patterned polymer film, observed normal to the substrate.

It is therefore intended that the foregoing detailed description be regarded as illustrative rather than limiting, and that it be understood that it is the following claims, including all equivalents, that are intended to define the spirit and scope of this invention.

The invention claimed is:

1. An electrohydrodynamic spray system, comprising:

an electrohydrodynamic spray apparatus having a liquid inlet;

a spray nozzle in fluid communication with the liquid inlet, the spray nozzle comprising an opening downstream of the liquid inlet;

an inner electrode inside the spray nozzle;

an outer electrode external to the spray nozzle, and detached from the spray nozzle while the electrohydrodynamic spray apparatus is in operation, and a substrate positioned downstream of the spray nozzle, wherein an end of the inner electrode is completely inside the nozzle, and wherein said end of the inner electrode is in the form of a needle point that applies a field injection charge to a liquid flowing through the spray nozzle to produce nanodrops; and wherein the spray nozzle is electrically insulated.

2. The electrohydrodynamic spray system of claim 1, wherein the substrate is electrically grounded.

3. The electrohydrodynamic spray system of claim 1, wherein the substrate is connected to a voltage source.

4. The electrohydrodynamic spray system of claim 1, wherein the substrate is non-conductive.

5. The electrohydrodynamic spray system of claim 1, wherein the outer electrode is positioned from 15 mm upstream of the opening to 15 mm downstream of the opening.

6. The electrohydrodynamic spray system of claim 1, wherein the outer electrode is configured as an open geometrical shape.

7. The electrohydrodynamic spray system of claim 6, wherein the outer electrode comprises at least two electrode portions.

8. The electrohydrodynamic spray system of claim 7, wherein the at least two electrode portions are electrically isolated from each other.

9. The electrohydrodynamic spray system of claim 1, wherein the outer electrode is configured as a closed geometrical shape.

10. The electrohydrodynamic spray system of claim 1, wherein the electrohydrodynamic spray apparatus further comprises a plurality of spray nozzles in fluid communication with the liquid inlet, each spray nozzle comprising an opening downstream of the liquid inlet;

an inner electrode at least partially inside each spray nozzle; and an outer electrode external to each spray nozzle, and within 100 mm of the opening.

11. The electrohydrodynamic spray system of claim 1, wherein the electrohydrodynamic spray apparatus and the substrate are moveably positioned relative to each other.

12. The electrohydrodynamic spray system of claim 1, further comprising a mask positioned between the electrohydrodynamic spray apparatus and the substrate.

13. The electrohydrodynamic spray system of claim 12, wherein the mask is connected to a voltage source.

14. The electrohydrodynamic spray system of claim 12, wherein the mask is non-conductive.

15. The electrohydrodynamic spray system of claim 1, wherein the outer electrode is configured as a cup, ring, cone, an elliptical ring, a polygon, a semicircle, a line, or a point.

16. The electrohydrodynamic spray system of claim 1, wherein the outer electrode has a diameter from 2 mm to 70 mm.

17. The electrohydrodynamic spray system of claim 1, wherein the end of the inner electrode is from about 0 mm to about 10 mm from the nozzle opening.

18. The electrohydrodynamic spray system of claim 1, wherein the end of the inner electrode is from about 0.5 mm to about 7.0 mm from the nozzle opening.

19. The electrohydrodynamic spray system of claim 1, wherein the end of the inner electrode is from about 1.5 mm to about 4.0 mm from the nozzle opening.

* * * * *